US005293174A

United States Patent [19]

Kropielnicki et al.

[11] Patent Number: 5,293,174

[45] Date of Patent: Mar. 8, 1994

[54] VEHICLE ANTENNA

[76] Inventors: Jerzy J. Kropielnicki, 40 Glebelands Road, Knutsford Cheshire; James D. Last, Orchard House, Gorddinog, Llanfairfechan, Gwynedd; Brian Easter, Slieve Donard, Talwrn Road, Llangefni, Gwynedd, all of United Kingdom

[21] Appl. No.: 975,963

[22] Filed: Nov. 13, 1992

Related U.S. Application Data

[63] Continuation of Ser. No. 688,712, Apr. 23, 1991, abandoned, which is a continuation of Ser. No. 458,625, Jan. 19, 1990, abandoned.

[30] Foreign Application Priority Data

May 21, 1987 [GB] United Kingdom ..... 8711995

[51] Int. Cl.[5] ..... H01Q 1/320; H01Q 1/380; H01Q 9/380

[52] U.S. Cl. ..... 343/713; 343/829

[58] Field of Search ..... 343/713, 715, 828, 873, 343/711, 712, 714, 825, 829, 845, 846; H01Q 1/32, 1/40

[56] References Cited

U.S. PATENT DOCUMENTS

| | | | |
|---|---|---|---|
| 3,922,684 | 11/1975 | Wright | 343/873 |
| 4,746,925 | 5/1988 | Toriyama | 343/713 |
| 4,757,322 | 7/1988 | Yokogawa et al. | 343/713 |
| 4,823,140 | 4/1989 | Shibata et al. | 343/713 |

FOREIGN PATENT DOCUMENTS

| | | | |
|---|---|---|---|
| 2429628 | 1/1976 | Fed. Rep. of Germany | 343/713 |
| 3334760 | 4/1985 | Fed. Rep. of Germany | 343/713 |
| 2571179 | 4/1986 | France | 343/713 |
| 0196605 | 11/1984 | Japan | 343/713 |
| 0031203 | 2/1987 | Japan | H01Q 320 |

*Primary Examiner*—Rolf Hille
*Assistant Examiner*—Peter Toby Brown
*Attorney, Agent, or Firm*—Shoemaker and Mattare, Ltd.

[57] ABSTRACT

The present invention relates to an antenna for use on a motor vehicle, particularly for cellular radio communication. The antenna comprises an elongate conductor applied to the surface of a vehicle window, the length of the antenna elongate conductor being a minor portion of the length of any peripheral side or edge of the vehicle window. A ground plane is provided along the top edge of the vehicle window, and the top end of the conductor antenna is grounded by virtue of its close proximity to the ground plane.

14 Claims, 3 Drawing Sheets

VEHICLE ANTENNA

This application is a continuation of Ser. No. 07/688,712, filed Apr. 23, 1991, and now abandoned, which is a continuation of Ser. No. 07/458,625, filed Jan. 19, 1990, and now abandoned.

FIELD OF THE INVENTION

This invention relates to an antenna for use on a motor vehicle, particularly for cellular radio.

BACKGROUND ART

It is well known to use the conductors of heated windows of motor vehicles as radio receiving and transmitting antennas.

Advantageously, such antennas do not project outside the vehicle and are not therefore susceptible to inadvertent damage or vandalization. Also, mounting holes in the vehicle bodywork can be avoided. Efficient reception can be achieved with such antennas on the usual AM and FM broadcast bands, and efficient transmission can be achieved in the 4 m to 2 m VHF mobile radio band, if necessary with the aid of matching and tuning circuitry.

Cellular mobile radio is now an important means of communication. However, the usual frequency range for this, i.e. 890–960 MHz, corresponds to a mid-band free-space wavelength of 324 mm and it is therefore not appropriate to use the conductors of a vehicle heated window as the antenna. In practice, a short whip antenna mounted on and projecting from the vehicle body is used.

DISCLOSURE OF THE INVENTION

An object of the present invention is to provide an antenna which is suitable for use with cellular radio yet which is incorporated in a vehicle window.

According to a first aspect of the invention, there is provided a vehicle window having a plurality of peripheral edges and an antenna for use with radio apparatus, said antenna comprising an elongate conductor applied to a surface of the window, characterizes in that the length of said conductor is a minor proportion of the length of any said peripheral edge.

With this arrangement it has been found possible to achieve good reception and transmission without unduly obscuring vision through the window. In particular, it has been found possible to achieve excellent reception and transmission with a conductor length which is shorter (e.g. at least 30% shorter) than the free-space quarter-wavelength of the mid-band frequency required to define a resonant monopole, due to the dielectric effect of the window glass to which the antenna conductor is applied. Thus, and in accordance with a second aspect of the invention, there is provided a vehicle having a window with an antenna comprising an elongate conductor applied to a surface of the window, and radio apparatus connected to said antenna, characterized in that said radio apparatus is operable in a predetermined frequency band and said conductor has a length less than the free-space quarter-wavelength of the mid-band frequency.

The conductor may comprise a straight length of a conductor and this may be applied to any vehicle window at any suitable position.

Conveniently, the conductor may be fixed to a vehicle rear window near the top edge thereof. Where the window also has heater wires, these should be separate from the antenna. The conductor preferably extends in a direction from a top edge towards a bottom edge of the window and thus, the conductor may extend in a vertical plane.

The vehicle window preferably further includes a conductive strip extending along at least part of one said peripheral edge, said conductor extending transversely to and having one end close to said strip, and said strip and said conductor being connected respectively to leads of a cable for connection to said radio apparatus whereby said conductive strip is arranged to provide a ground plane for said antenna.

BRIEF DESCRIPTION OF THE DRAWINGS

The invention will now be described further by way of example only and with reference to the accompanying drawings in which.

BEST MODE OF CARRYING OUT THE INVENTION

Figure 1:
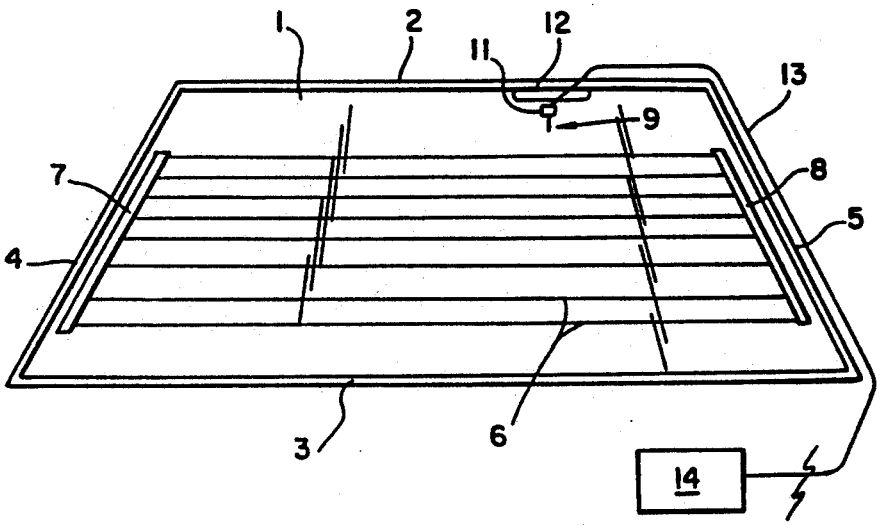
FIG. 1 is a diagrammatic view of one form of a window according to the invention.

The window is a rear window of a motor car, although it is to be understood that the invention can be applied to any suitable window of any suitable vehicle.

The window comprises a glass pane 1 which is generally rectangular or trapezoidal and has top and bottom long edges 2, 3 which extend at least substantially horizontally, and two short upright side edges 4, 5. The pane 1 may be flat or curved and lies in a plane (or is curved relative to a plane) which is substantially vertical or inclined to the vertical, as is conventional. The pane 1 fits within an opening in a metal body of the vehicle and is sealed relative to the periphery of the opening with a sealing gasket formed from rubber or similar material.

The pane 1 incorporates a heater (demister) which comprises a series of parallel, horizontal wires 6 running between upright busbars 7, 8, such wires and bars being incorporated in the inner surface of the glass pane or applied thereto e.g. as narrow, flat, printed, conductive strips. The bus bars 7, 8 are connected to the usual d.c. power supply of the motor car via an operating switch. Thus, one busbar 7 is connected to earth (i.e. the car body), and the other busbar 8 is connected by a lead to positive power supply via an operating switch which may be located for example on the car dashboard.

The heater wires 6 extend across a major part of the surface area of the window pane but there is a space between the top edge 2 of the window pane 1 and the uppermost heater wire 6. In this space there is a short, straight upright conductor 9 which is incorporated in or applied to the inner surface of the pane. Thus, the conductor 9 may comprise a 0.4 mm wire fixed by adhesive to the surface of the pane 1, or the conductor may comprise a narrow flat printed conductive strip, say 1 to 1½ mm wide.

The conductor 9 lies in a vertical plane and terminates at its upper end 10 close to the top edge 2 of the window pane 1 near to, but well spaced from one side edge 5. The top end 10 of the conductor 9 has thereat a portion of increased width which forms a square terminal 11, say 3½ to 4 mm square.

There is a space between the terminal 11 and the top edge 2 of the window pane 1 and within this space there is a flat strip 12 which is applied to the surface of the pane 1 and extends horizontally along part of the top edge 2. This strip 12, like the conductor 9 and the terminal 11, may be a flat printed conductive strip (say 10–20 mm wide) of similar nature to the printed strips conventionally used for window heaters (demisters).

A very narrow gap (say 1–2 mm) is defined between the terminal 11 and the strip 12 and the terminal 11 is located in the middle of the strip 12.

A coaxial cable 13 has its central conductor connected to the terminal 11 and its outer conductor connected to the middle of the strip 12 immediately above the terminal 11. The cable 13 is led around the interior of the car to a conventional cellular radio/transmitter 14 which may be mounted e.g. on the car dashboard. The cable 13 is connected directly to the usual antenna socket of the radio/transmitter. The radio/transmitter is tuned to operate in the usual cellular radio band, i.e. 890–960 MHz.

Figure 2:
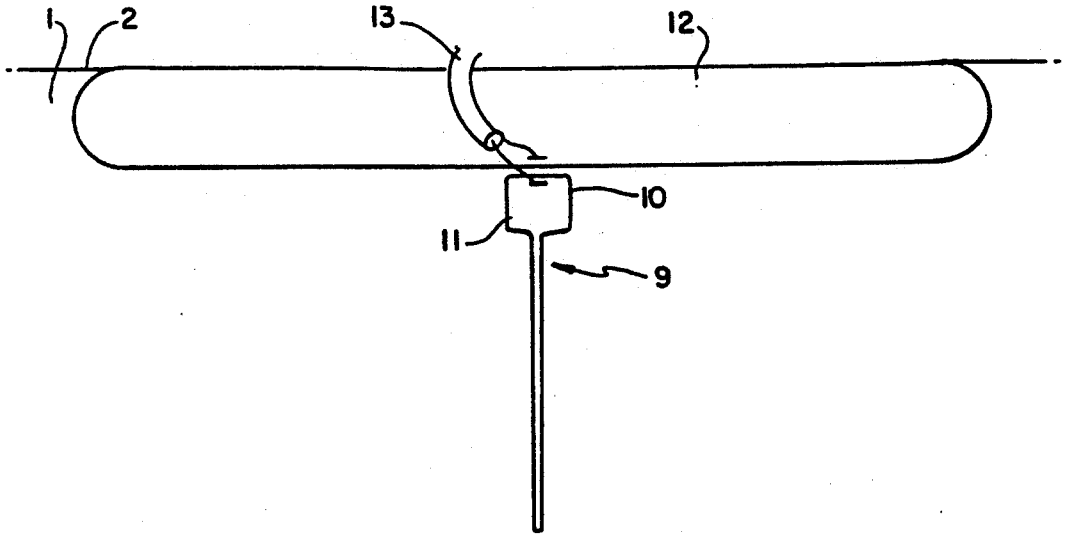
FIG. 2 is an enlarged view of a detail of the window.

The conductor 9 acts as an antenna for the radio/-transmitter 14 and the strip 12 acts to define a ground plane for the antenna. The strip 12 extends up to the edge 2 of the window pane 1 and in effect forms part of the vehicle body in so far as the strip contacts the body or is so close to the body as to be capacitively linked thereto. As shown in FIG. 2, the longer side of the separate conductive strip 12 extends along and contacts one peripheral edge 2 of the window 1 to provide a ground plane for the antenna. The width of the strip 12 is large enough to ensure that the strip projects beyond any peripheral window trim thereby to avoid spurious capacitive effects with the trim. The length of the strip 12 is not critical but preferably is greater than half the wavelength of the central frequency of the band to which the radio/transmitter is tuned.

The conductor 9 is relatively short, that is, the length of the conductor 9 is much less than the length of any of the edges 2, 3, 4, 5 of the window pane 1. Moreover the length of the conductor 9 is less than the quarter-wavelength of the middle frequency of the band to which the radio apparatus is tuned. More specifically the effective length of the conductor 9, i.e. the length from the bottom end of the conductor to the bottom edge of the ground plane strip 12 is trimmed to give resonance at the mid-band frequency of 925 MHz of the band to which the radio apparatus is tuned. In practice, the length will be approximately 55 mm which is approximately 30% less than the free-space quarter-wavelength, this being possible due to the dielectric effect of the glass which modifies the antenna properties of the conductor 9.

The coaxial lead is connected directly to the radio apparatus and matching circuitry or the like is not required since the antenna structure provides 'ideal' matching to the radio apparatus.

A bandwidth of the order of 100 MHz (1.3:1 vswr) is attainable.

It is of course to be understood that the invention is not intended to be restricted to the details of the above embodiment which are described by way of example only.

Thus, for example, instead of being applied directly to the surface of the window pane 1, the conductor 9 (and/or the strip 12) may be applied to a small transparent sheet of soft plastic (e.g. by printing on the plastic), such sheet being affixed to the window pane 1 by adhesive or by virtue of the adherent properties of the plastic material. Also, although the antenna is shown applied to a rear window, it is to be understood that it may be applied to a side or front window. Being so small, the antenna does not significantly obscure vision.

Figure 3:
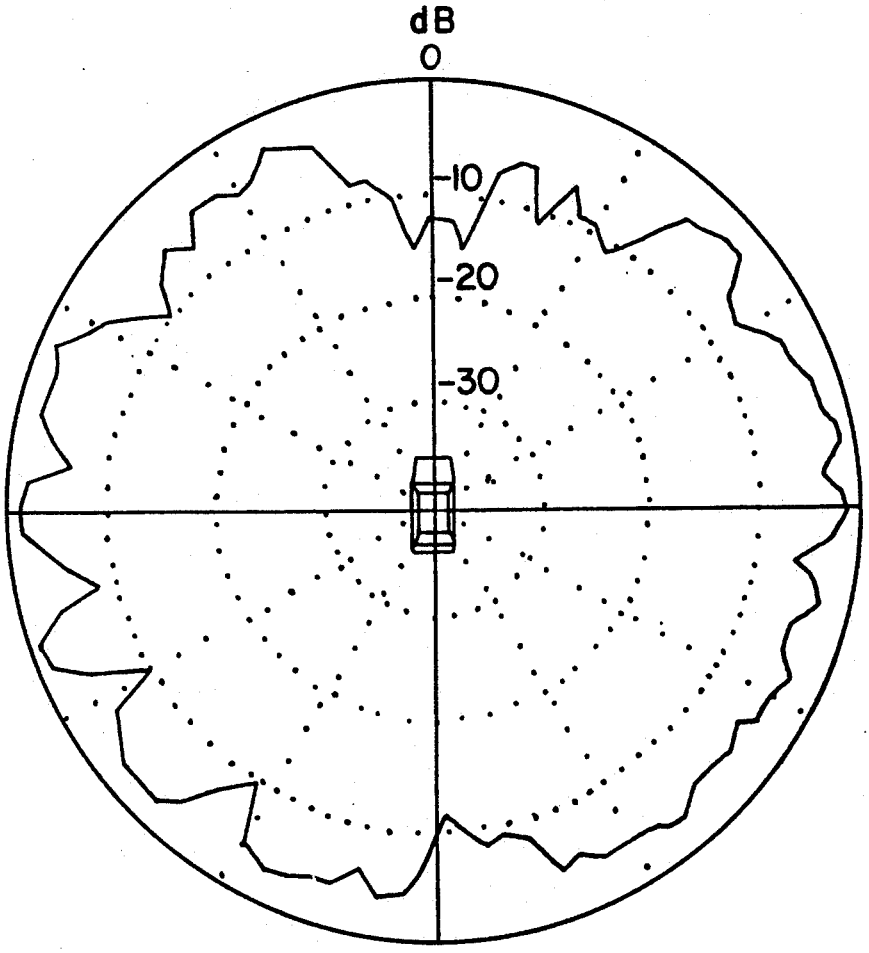
FIG. 3 (PRIOR ART)
FIGS. 3 and 4 are polar diagrams showing performance of different antennas.
Figure 4:
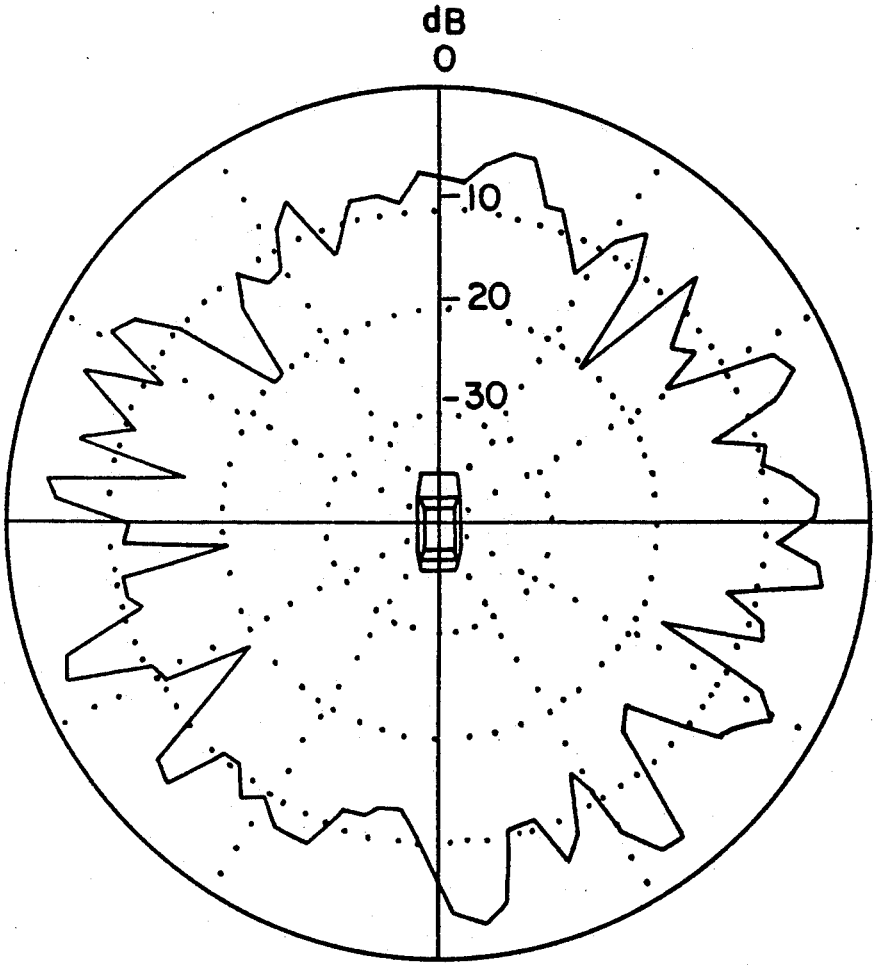

FIG. 3 shows typical performance of a conventional roof-mounted rod antenna (effectively quarter-wave monopole), and FIG. 4 shows typical performance of the antenna of FIGS. 1 and 2.

FIGS. 3 and 4 are polar diagrams recorded by driving a car (Ford Granada) fitted with the antennas in a tight circle at a distance in the range 200–500 m from a low power 925 MHz test transmitter. FIG. 3 shows the power of the received signal with the roof-mounted monopole, and FIG. 4 shows the power of the received signal with the antenna of FIGS. 1 and 2 applied to the rear window. The polar diagrams show that the performance obtained with the antenna of FIGS. 1 and 2 is roughly comparable with that of a conventional antenna.

We claim:

1. A vehicle window having a plurality of peripheral edges comprising a top edge, a bottom edge and two side edges, and an antenna for use with radio apparatus, said antenna comprising in combination an elongate conductor, applied to one surface of said window, and a separate conductive strip also applied to said surface of the said window and defining a ground plane for the said antenna, the longer side of said conductive strip extending along and contacting one of said peripheral edges to provide said ground plane, the length of said longer side of the said conductive strip extending along and contacting said one of said peripheral edges to provide the said ground plane being greater than half the wavelength of the central frequency of the frequency band to which said radio apparatus is tuned, said elongate conductor having terminal means at its one end and located adjacent to the said strip and separated from said strip by a narrow gap defined between said terminal means and the said strip, and the other end of the said elongate conductor projecting away from said strip, the length of said elongate conductor being a minor proportion of the length of any of said peripheral edges.

2. A vehicle window according to claim 1, wherein said elongate conductor extends between said top edge and said bottom edge of said vehicle window.

3. A vehicle window according to claim 1, wherein said separate conductive strip extends along and contacts said top edge of said vehicle window, said strip and said elongate conductor being connected respectively to two separate conductors of a cable for connection to said radio apparatus.

4. A vehicle window according to claim 1, wherein said antenna is for use with radio apparatus operable in the frequency band 890–960 MHz, and the length of said elongate conductor is less than the free-space quarter-wavelength of the mid-band frequency.

5. A vehicle window according to claim 2, wherein said antenna is for use with radio apparatus operable in the frequency band 890–960 MHz, and the length of said elongate conductor is less than the free-space quarter-wavelength of the mid-band frequency.

6. A vehicle window according to claim 3, wherein said antenna is for use with radio apparatus operable in the frequency band 890–960 MHz, and the length of said elongate conductor is less than the free-space quarter-wavelength of the mid-band frequency.

7. A vehicle window according to claim 4, wherein said other end of said elongate conductor is spaced from said conductive strip by a distance less than the free-space quarter-wavelength of the mid-band frequency.

8. A vehicle window according to claim 1, wherein said other end of said elongate conductor is spaced from said conductive strip by a distance less than the free-space quarter-wavelength of the mid-band frequency.

9. A vehicle window according to claim 2, wherein said other end of said elongate conductor is spaced from said conductive strip by a distance less than the free-space quarter-wavelength of the mid-band frequency.

10. A vehicle window according to claim 7, wherein said distance is at least 30% less than said free-space quarter-wavelength of the mid-band frequency.

11. A vehicle window according to claim 7, wherein said distance is not more than 70% of the free-space quarter-wavelength of the mid-band frequency.

12. A vehicle window according to claim 1, wherein said length of said conductor is at least 30% less than said free-space quarter-wavelength of the mid-band frequency.

13. A vehicle window according to claim 1, wherein said radio apparatus includes transmitting circuitry for transmitting radio signals in the predetermined frequency band via said antenna.

14. A vehicle window having a plurality of peripheral edges comprising a top edge, a bottom edge and two side edges, and an antenna for use with radio apparatus, said antenna comprising in combination an elongate conductor applied to one surface of said window, the dimensions of said elongate conductor being precisely defined for the said antenna to be resonant at the mid-band frequency in the frequency band 890–960 MHz, and a separate conductive strip applied to said surface of the said window and defining a ground plane for the said antenna, the length of the longer side of said separate conductive strip providing said ground plane being greater than half the wavelength of the central frequency of the frequency band to which said radio apparatus is tuned and the longer side of the said separate conductive strip extending along and contacting one of said plurality of peripheral edges to provide the said ground plane, said elongate conductor having terminal means at its one end and located adjacent to the said strip and separated from said strip by a narrow gap defined between said terminal means and the said strip, and the other end of the said elongate conductor projecting away from said strip, the length of said elongate conductor being a minor portion of the length of any of said peripheral edges and the whole of said antenna being capable of being used as an antenna for radio reception and transmission in said frequency band 890–960 MHz.

* * * * *